United States Patent [19]

Warsinski et al.

[11] 4,147,200

[45] Apr. 3, 1979

[54] METHOD AND APPARATUS FOR ELIMINATING ENTRAPPED GAS IN DIE CASTINGS

[75] Inventors: Robert G. Warsinski, Southfield; George R. Wlodyga, Walled Lake, both of Mich.

[73] Assignee: Ford Motor Company, Dearborn, Mich.

[21] Appl. No.: 814,519

[22] Filed: Jul. 11, 1977

[51] Int. Cl.[2] ..... B22D 17/32; B22D 17/10

[52] U.S. Cl. ..... 164/4; 164/154; 164/155; 164/314

[58] Field of Search ..... 164/4, 155, 314, 315, 164/154, 156, 150, 133; 425/143, 149, 145

[56] References Cited

U.S. PATENT DOCUMENTS

| | | | |
|---|---|---|---|
| 2,786,234 | 3/1957 | Beyer | 164/154 X |
| 3,731,727 | 5/1973 | Mitamura et al. | 164/315 X |
| 3,842,893 | 10/1974 | Booth | 164/4 |
| 3,964,537 | 6/1976 | Koch et al. | 164/315 X |

*Primary Examiner*—Richard B. Lazarus
*Assistant Examiner*—Gus T. Hampilos
*Attorney, Agent, or Firm*—Paul K. Godwin, Jr.; Keith L. Zerschling

[57] ABSTRACT

In a die casting machine a shot of molten material is transferred through an injection tube at a relatively slow speed so that all the gas present in the tube is forced out through the associated die. When a first portion of the molten material reaches the die cavity, the event is automatically sensed by circuitry which commands the machine to transfer the remainder of the molten material through the injection tube at a relatively fast speed and cause injection thereof into the die.

10 Claims, 6 Drawing Figures

FIG. 1A.
Ladled
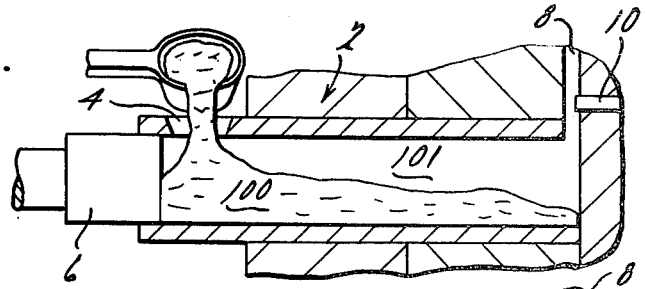
FIG. 1B.
Slow Shot Speed To Evacuate Gas
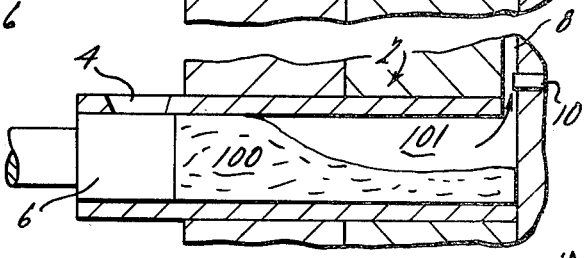
FIG. 1C.
Switch To Fast Shot Speed For Die Injection
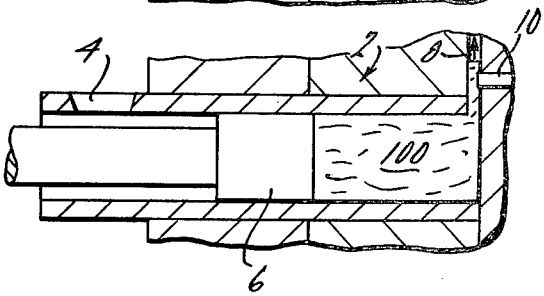
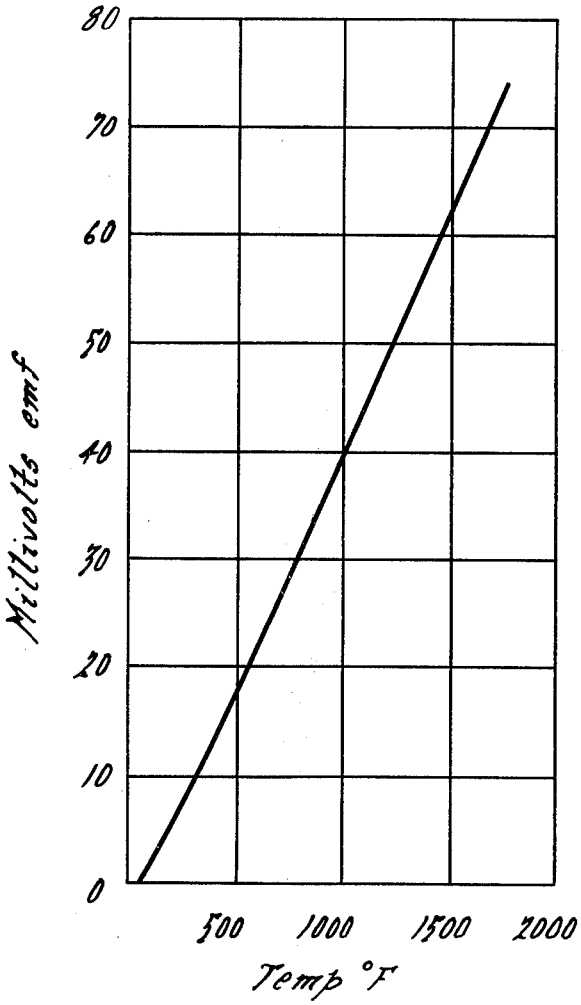
FIG. 4.

METHOD AND APPARATUS FOR ELIMINATING ENTRAPPED GAS IN DIE CASTINGS

BACKGROUND OF THE INVENTION

1. Field of the Invention

The present invention relates to the field of die casting and more particularly to method and apparatus for the control of die casting machines.

2. Description of the Prior Art

In the art of die casting, one of the major problems encountered has been termed "gas entrapment". This problem is caused by the injection of air intermixed with molten material into a die which is used to form a casting. The intermixing of the air into the molten material causes such defects as blisters or internal cavities which may render the casting to be of inferior quality.

In the paper entitled "Metallographic Analysis of Zinc Die Castings", by Sanders et al, presented at the 6th SDCE International Die Casting Congress on Nov. 16, 1970, the effect of gas entrapment was recognized as the cause of blisters at the surface of die castings. Gas entrapment was also postulated as the cause of flow lines which appear as boundaries between distinct regions on the surface of the casting.

A proposal for overcoming the gas entrapment problem was offered in a paper entitled "Optimum Utilization of Die Casting Machines With Metrology", by James I. Moore, presented at the 8th SDCE International Die Casting Exposition and Congress, Mar. 17, 1975. The solution constituted a preprogrammed sequence of steps wherein a predetermined volume of molten metal "shot" was ladled into an injection tube containing a speed controlled plunger for ramming the metal into the die. The initial speed at which the plunger advanced, called the "shot speed", was relatively slow and preselected so that a wavefront developed in the molten material and tended to evacuate the air from the injection tube, through the die. After a predetermined time period, the plunger was then driven at a fast shot speed in order to inject the molten metal into the die.

The major disadvantage of the above solution was that it required a rather lengthy set-up time for each change in materials or dies. The set-up included a significant amount of experimentation to select the correct slow shot speed for a proper wave profile and determine the precise time in each injection cycle at which the change is made to the high shot speed. Of course, a second disadvantage was that the volume of molten material ladled into the cold chamber was also predetermined so that the predetermined time period would remain constant.

SUMMARY OF THE INVENTION

The present invention is intended as an improved method and apparatus for eliminating gas entrapment problems in die castings. The present invention has the advantage of not being constricted by a rigid time sequence, but rather employs a monitored event sequence which allows for wider range in volume of molten material input to the injection tube and results in castings of more consistent high quality.

In a preferred embodiment of the subject invention, an injection tube having an open end communicates with a die cavity for injecting molten material therein. The other end of the injection tube extends outside of the die and has an opening therein to receive molten material for subsequent injection and casting. A driven injection plunger is mounted within the injection tube to force the molten material towards the die. At first, the injection plunger is driven at a slow speed in order to force any air that is vertically above the molten material through the die cavity. When the molten material volume equals the volume of the injection tube between the plunger and the opening to the die cavity, the air will have been forced out through the die cavity and the molten material will start to enter a runner cavity, which supplies the communication between a main portion of the die cavity and the injection tube.

In order that the system is able to detect the entry of the molten material into the runner cavity, a thermal sensor is mounted therein. Circuitry is employed for sampling the sensed ambient temperature of the runner cavity, at the time the injection plunger commences its injection cycle at the slow shot speed. The circuitry automatically stores the sampled ambient value and then monitors the output of the thermal sensor until it reaches a predetermined level above the stored ambient value. The predetermined level above the die ambient is selected so as to positively distinguish between the evacuating gas and the molten material temperatures. At that time, the fast shot speed signal is communicated to the driving control mechanism, causing the injection plunger to be driven at a high shot speed in order to ram inject the molten material into the main portion of the die cavity.

It should be noted that since the die ambient temperature varies between room temperature, when the casting machine is cold, and approximately 300° F., during continual usage (depending upon the particular material used and cycling frequency), the measurement of the absolute temperature of the molten material as it enters the die cavity would cause wide variations in the time period between die cavity entry and switching the plunger to fast shot speed injection. The present invention, therefore, stabilizes the time required by the circuit to effect switching, no matter what the ambient temperature of the die might be.

It is an object of the present invention to provide an improved method of die casting by sensing the entry of the molten material into a die and controlling the injection speed in response thereto.

It is another object of the present invention to provide an improved apparatus for controlling injection plunger speed to eliminate the problem of gas entrapment in castings.

It is a further object of the present invention to provide novel circuitry for sensing and holding an ambient die cavity temperature value, and comparing the ambient value with later sensed values until a predetermined difference level is reached that corresponds to the entry of molten material into the die.

Further objects of the invention will be apparent to those skilled in the art from the below detailed description of the preferred embodiment.

BRIEF DESCRIPTION OF THE DRAWINGS

FIGS. 1A, 1B and 1C illustrate how the subject invention eliminates the problem of gas entrapment in die castings.

FIG. 3 is a schematic diagram of an electrical circuit of the present invention which produces a signal indicating the presence of molten material in the die cavity.

FIG. 4 is a graph showing the temperature response characteristics of a Type E thermocouple, such as that employed as a thermal sensor in the preferred embodiment of the present invention.

DESCRIPTION OF THE PREFERRED EMBODIMENT

Figure 2:
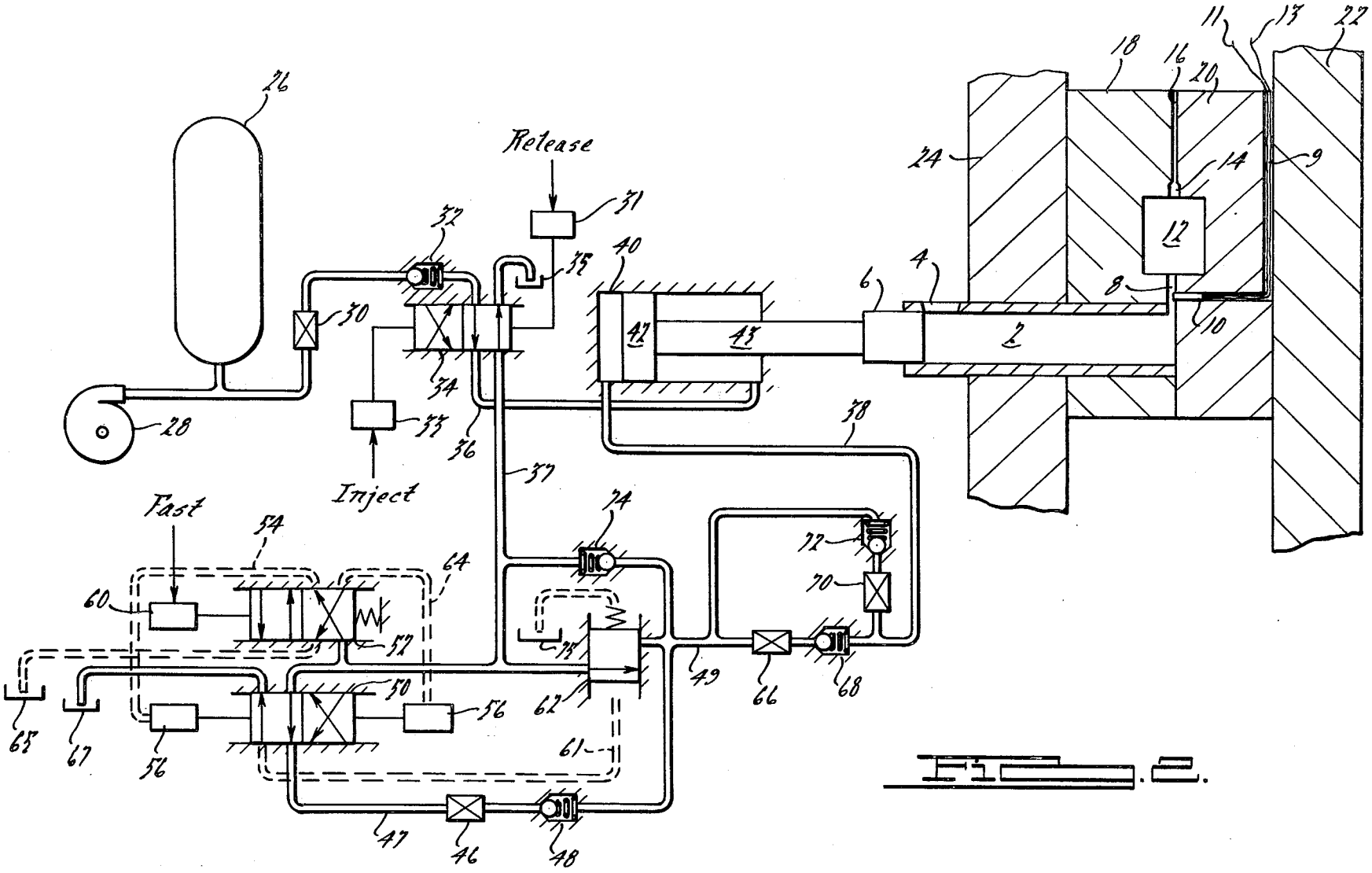
FIG. 2 is a schematic diagram showing an overall hydraulic system as employed in the preferred embodiment of the present invention.
Figure 2:
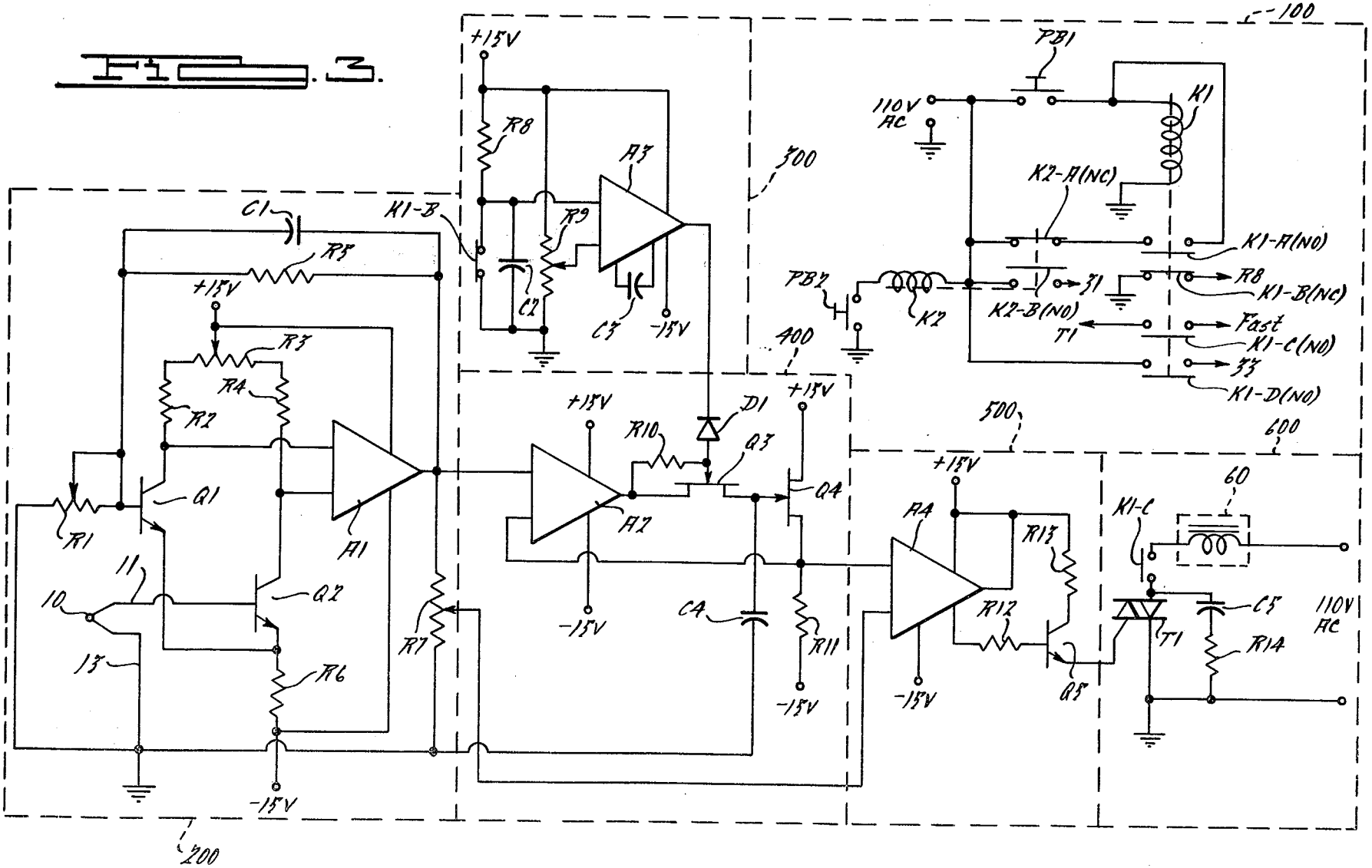

FIGS. 1A–1C conceptually illustrate events which occur during the injection process in the die casting operation of the present invention. The elements shown in FIGS. 1A–1C correspond to elements shown in FIG. 2 and are labeled with corresponding reference characters.

In the casting process, molten material 100 is typically entered into an injection tube 2 through an opening 4 in the upper portion of the injection tube 2, at a remote end thereof. The opposite end of the injection tube 2, from the opening 4, communicates with a die cavity which includes a runner cavity 8 located vertically above the injection tube. An injection plunger 6 is mounted for reciprocation within the injection tube 2; and, in this case, is hydraulically controlled for movement, between the remote end and the communicating end at the die, to force the molten material 100 through the runner cavity 8.

In FIG. 1A, the molten material 100 is shown being ladled into the injection tube 2 through the opening 4 and displacing its volume of air. After a quantity of molten material 100, called a "shot", is ladled into the injection tube 2, a volume of air 101 is also present therein.

In order to prevent intermixing of the air 101 into the molten material 100, as the material is injected into the die, the plunger 6 is translated in the injection tube 2, from the remote end, at a slow speed. The slow speed at which the plunger 6 is translated within the injection tube 2, is termed the "slow shot speed" and is selected according to the particular characteristics of the molten material employed. The speed is selected as being slow enough not to cause the molten material to be forced up through the opening 4 and slow enough to cause all the air to be evacuated from the injection tube 2 when the molten material reaches the runner cavity 8. However, the slow shot speed is also selected as being fast enough to prevent excessive cooling of the molten material while it is in the injection tube 2.

As can be seen from FIG. 1B, the injection plunger 6 advances the molten material 100 towards the die end of the injection tube 2 to thereby force evacuation of the air 101 from the injection tube 2. When all of the air 101 is evacuated from the injection tube 2, as shown in FIG. 1C, the molten material 100 is forced through the runner cavity 8 and over a thermal sensor 10, mounted in the runner cavity 8. At this time, a circuit, to be described later, detects the entry of the molten material 100 into the die cavity.

The overall operation of the hydraulic system controlling the injection plunger 6 is shown in FIG. 2 and discussed below. The injection tube 2 is shown as extending through a machine platen 24 and a die half 18 where it is communicated with a main portion 12 of the die cavity, via a runner cavity 8. A second machine platen 22 supports a second die half 20. The two die halves 18 and 20 form a die cavity which includes the runner cavity 8, the main portion 12, an overflow cavity 14 and a vent cavity 16. Of course, several overflow and vent cavities may be used in any particular die. These overflow and vent cavities are generally employed wherever air is likely to be trapped by the sudden rush of the molten material into the main portion 12 of the die cavity.

The die half 20 also includes a conduit 9 which runs from an external edge, near the machine platen 22, to the runner cavity 8. The purpose of the conduit 9 is to provide electrical access via wires 11 and 13 to a thermal sensor 10, which is mounted in the conduit 9 at the runner cavity 8.

It should be understood that the hydraulic system, shown in FIG. 2, is in its "release" state, wherein the injection plunger 6 is positioned at the remote end of the injection tube 2 in position to receive a shot of molten material.

A pump 28 is used to generate a pressure of approximately 1000 psi within the hydraulic system. The hydraulic pump 28 is connected to a hydraulic accumulator 26, an adjustable valve 30, and a check valve 32 for regulation. A 4-way valve 34, shown in its "release" position, allows hydraulic fluid pressure to be applied through line 36 to an injection cylinder 40.

The injection cylinder 40 contains a piston head 42, which is connected through an arm 43 to the injection plunger 6. For convenience of description, the portion of the cylinder 40 communicating with the hydraulic line 36 is referred to hereinafter as the "lower portion" and the portion of the cylinder 40 communicating with a hydraulic line 38 is referred to hereinafter as the "upper portion".

The application of the pressure through line 36 to the lower portion of the injection cylinder 40 causes the piston head 42 to be translated to the upper portion of the injection cylinder 40. The 4-way valve 34 is switched between its two possible settings by the alternate activation of electric valve control solenoids 31 and 33. The solenoid 31 is activated by a "release" signal, from an injection start/release relay circuit 100 shown in FIG. 3, and switches the valve to the setting shown in FIG. 2. The solenoid 33 is controlled by an "inject" signal, from the injection start/release relay circuit 100, and causes the 4-way valve 34 to be switched to the setting that allows the hydraulic fluid pressure to be applied through line 37. Fluid flowing through line 37 also flows through a 4-way valve 52, enters a valve control line 54 and flows to a hydraulic valve control 56, which sets a 4-way valve 50 in a first of two possible settings. The first setting of valve 50 allows fluid from line 37 to flow through in line 47 to valve 46, which is manually set to control the rate at which the hydraulic fluid eventually enters the upper portion of injection cylinder 40 via line 38.

A "slow speed line" is defined by the line 47, valve 46, and a check valve 48, since the setting of the valve 46 determines the initial speed at which the plunger 6 is to be translated in the injection tube 2. The fluid exiting the check valve 48, travels through the line 49, through a valve 66, a check valve 68 and line 38 prior to entering the upper portion of the injection cylinder 40 to force the piston 42 and the connected injection plunger 6 toward the die.

As described above, when the molten material is detected as entering the runner cavity 8 by the thermal sensor 10, a signal is communicated to the circuitry shown in FIG. 3. An output of that circuitry is connected to the electric valve control 60 as a "fast" signal, activating the control 60 and causing the hydraulic system to force the plunger 6 into the injection tube 2 at a high speed to thereby effect rapid injection of the molten material into the die cavity.

The following discussion of the hydraulic system assumes the receipt of a "fast" signal at the electric valve control 60, causing the 4-way switch 52 to be switched to a second of two settings.

When the 4-way valve 52 is switched to its second setting, the fluid from line 37 is communicated, via line 64, to a hydraulic valve control 56. The hydraulic valve control 56 switches the 4-way valve 50 to its second of two settings, disconnecting pressure to the slow speed line and applying pressure to a pressure valve control line 61. The pressure valve control line 61 is connected to a pressure control valve 62 which allows a relatively high volume of fluid to flow from the line 37 to the line 49 at a regulated high pressure. The output from the pressure control valve 62 is applied through line 49, valve 66, check valve 68, and line 38, to the upper portion of the injection cylinder 40, thereby causing high speed movement of the piston 42 and the injection plunger 6 toward the die cavity.

Subsequent to the injection of the molten material into the die cavity, and upon the lowering of the temperature of the molten material to a temperature sufficient to allow ejection of the casting from the die cavity, a "release" signal is generated, by the injection start/release relay circuit 100, and applied to an electric valve control 31 which switches the 4-way valve 34 to the position shown in FIG. 2. At this time, the piston 42 is forced to the upper portion of the injection cylinder 40 and the fluid in the upper portion of the injection cylinder 40 is forced therefrom, through line 38, a valve 70, a check valve 72, line 49, a check valve 74, line 37, and 4-way valve 34 to a reservoir 35. At that point the system has completed a full casting cycle and is ready for the beginning of a subsequent cycle.

A feedback circuit for automatically controlling the injection speed of the aforementioned die casting machine, is shown in FIG. 3. The feedback circuit is divided into six separate, but interrelated, circuits. The six circuits and their interrelationships with each other, are fully discussed below.

Since one of the objectives of the present invention is to provide for accurate sensing of the pressence of the molten material in the die cavity at a predetermined time following the actual entry, without regard to the variations in the ambient temperature of the die, the feedback circuitry is designed to sense the ambient temperature of the die for a predetermined time period commencing with the start of the injection cycle. The circuitry then holds that value of ambient die temperature, and tracks the die temperature values over the remainder of the cycle until the temperature sensor indicates an increase in temperature which exceeds a predetermined value (e.g. 150° F.) above the ambient die temperature value held in the circuit. At that point, an output circuit is commanded to energize the electric valve control 60 and switch the hydraulic system to drive the injection plunger at a fast shot speed.

A typical injection start/release relay circuit 100 is shown in FIG. 3, wherein a momentarily activated push button switch PB1, designated as the "start" button, connects the source voltage to the holding relay K1. Upon the activation of the push button switch PB1, the coil of holding relay K1 is energized to switch its associated contacts from normally open positions to closed positions and from normally closed positions to open positions. Specifically, contact K1-A, which is normally open, is closed by the energization of the coil of relay K1 and is connected to hold the coil of relay K1 in an energized state after the push button PB1 is released.

A push button switch PB2, designated as the "release" button, is connected so as to energize the coil of relay K2, and thereby switch the associated normally closed contact to an open condition and its normally open contact to a closed position. The normally closed contact K2-A is connected in series with the contact K1-A. Therefore, when the release button PB2 is depressed, the relay K1 is deactivated by the opening of K2-A. The activation of the release push button PB2 also causes a "release" signal to be communicated to the electric valve control 31 shown in FIG. 2. Other associated K1 relay contacts are shown with various connection indications and are more fully discussed below.

A thermal sensor amplifier 200, shown in FIG. 3, is connected to the thermal sensor 10 via electrical connections 11 and 13. The thermal sensor amplifier 200 utilizes a differential design wherein an operational amplifier A1 amplifies the difference between a gain input and a separate signal input from the thermal sensor. In the present embodiment, the thermal sensor 10 is a Type E (Chromel-Constantan) thermocouple having temperature/emf characteristics approximating those shown in FIG. 4. However, it should be understood that other types of thermocouples or infra-red sensors could be used in this embodiment.

Monolithic dual NPN transistors Q1 and Q2 have collectors connected to the respective gain and signal inputs of the operational amplifier A1. Q1, Q2 and A1 form the active portion of a low-drift differential amplifier. The transistor Q1 has a base connected to a gain potentiometer R1, which serves to adjust the gain reference voltage at the collector of Q1 connected to the gain input of operational amplifier A1. The collector of transistor Q1 is also connected to a load resistor R2 in series with a portion of a null potentiometer R3, which has a wiper connected to a positive voltage supply. The emitter of the transistor Q1 is connected in common with the emitter of the transistor Q2 to one side of a resistor R6. The other side of the resistor R6 is connected to a negative voltage supply.

One of the leads 13, from the thermal sensor 10 is connected to ground while the lead 11 is connected to the base of the transistor Q2. A collector of the transistor Q2 is connected to both the signal input of the operational amplifier A1 and one end of a load resistor R4. The opposite end of the resistor R4 is connected to the null potentiometer R3.

In order to calibrate the operational amplifier and obtan a zero level output for a zero level input, the base of the transistor Q2 is grounded and the null potentiometer R3 is adjusted until the output of the amplifier A2 has a zero output level. After the initial setting, the ground is removed from the base of the transistor Q2 so that the thermocouple output is amplified according to the gain setting of the resistor R1. The preferred embodiment operates with a gain of about 200.

A capacitor C1 and resistor R5 are connected in parallel between the output of the operational amplifier A1 and the base of transistor Q1 to provide limited feedback and reduce the effect of any electrical noise which might be present.

A track and hold circuit 400, controlled by a track and hold mode control circuit 300, receives the output from the thermal sensor amplifier 200 over a prescribed period of time following the start of the injection cycle in the die casting machine. The track and hold mode control circuit 300 acts as a timer for the prescribed time period which begins at the start of the injection cycle. When the prescribed time period has elapsed, a signal is sent from the mode control circuit 300 commanding the track and hold circuit 400 to hold an output signal level corresponding to the output of the thermal sensor amplifier 200 at the time of mode switching.

Specifically, the track and hold circuit 400 comprises an operational amplifier A2 having one of two input terminals connected to receive the output of the thermal sensor amplifier 200. The output of the operational amplifier A2 is connected to the source of a junction field effect transistor (JFET) Q3. The gate of the JFET Q3 is connected to receive a mode switching signal through diode D1 from the track and hold mode control circuit 300. The drain of the JFET Q3 is connected to the gate of the second JFET Q4 and also to a charging capacitor C4. The drain of the JFET Q4 is connected to the positive voltage source while the output of the circuit is taken from the source of the JFET Q4. The source of the JFET Q4 is also connected to the inverting input of the operational amplifier A2 for feedback purposes.

In operation, the track and hold circuit 400 receives a positive signal from the track and hold mode control circuit 300 and allows the JFET Q3 to turn on and "track" the signal output of the operational amplifier A2 in response to the signal output from the thermal sensor amplifier circuit 200. After the prescribed time period has lapsed, the track and hold mode control circuit 300 applies a negative voltage to the diode D1, turning the JFET Q3, off and thereby leaving charging capacitor C4 charged to a level corresponding to the output level of the thermal amplifier circuit 200 at the time when the negative voltage is applied. Accordingly, this is termed the "hold" mode.

The JFET Q4 provides a complete buffering to the charging capacitor C4, since the output of the circuit is taken from the source of Q4 and the charge stored in capacitor C4 remains due to an extremely low leakage through the off gated drain of JFET Q3 and gate of JFET Q4.

The track and hold mode control circuit 300 comprises an operational amplifier A3 which is connected as a voltage comparator supplying a positive signal (15 volts) output during a "track" mode and a negative signal (−15 volts) output during a "hold" mode. In the track and hold mode control circuit 300, a resistor R8 is connected between the positive voltage source and the first input to the operational amplifier A3. A charging capacitor C2 is connected between the first input to the operational amplifier A3 and ground. A normally closed relay contact K1-B (detailed in circuit 100) is connected to shunt capacitor C2.

A potentiometer R9 has its resistor terminals respectively connected to the positive voltage source and ground. The wiper of the potentiometer R9 is connected to a second input of the operational amplifier A3 and is adjustable to preset a "track" mode time period to sense the ambient temperature.

In operation, the relay K1 is energized by the momentary depressing of push button PB1 in the injection start/release circuit 100. The energized K1 causes the normally closed contact K1-B to open. At that moment, a series RC network comprising resistor R8 and charging capacitor C2 is formed so that the capacitor C2 charges at the rate determined by the respective RC values. When the voltage level at the junction between R8 and C2 equals the voltage potential at the wiper of potentiometer R9, the operational amplifier A3 switches its output from the positive source voltage level to the negative source voltage level. Conceptually, the track and hold mode control circuit 300 initiates a "track" enabling mode to the track and hold circuit 400 upon the activation of the relay K1. After a predetermined amount of time determined by the setting of potentiometer R9 and the RC network comprising resistor R8 and capacitor C2, the track and hold mode control circuit disables the JFET Q3 and places the track and hold circuit 400 in a "hold" mode.

A comparator circuit 500 receives two inputs to its operational amplifier A4. A first input is received from the output of the track and hold circuit 400. A second input is received from a potentiometer R7, as a real time value of the output of the thermal sensor amplifier 200 reduced by the setting of potentiometer R7. The setting of resistor R7 is made during the track mode in order to bias the comparator circuit in a normally off condition by an amount corresponding to the pedetermined amount of temperature value (e.g. 150° F.) which must be exceeded to indicate the actual entry of molten material into the die cavity. Therefore, when the track and hold circuit enters the hold mode, the signal level input to the comparator circuit from the potentiometer R7 exceeds the biasing level. The biasing level is selected to be no more than enough to prevent switching of the comparator circuit by electrical noise and to prevent switching of the comparator circuit by hot gases flowing through the runner cavity 8. The level of potentiometer R7 is set so that the comparator circuit not only distinguishes the molten material entry from hot gas, but also provides a constantly instantaneous indication of molten material entering the die cavity.

The output from the operational amplifier A4 in the comparator circuit 500 is sensed through a resistor R12 by the base of a buffer transistor Q5. The emitter of the buffer transistor Q5 supplies the output of the comparator circuit 500 to the gate terminal of a triac T1 in the output circuit 600.

One of the main terminals of the triac T1 is connected to the normally open relay contact K1-C and to the capacitor C5. The capacitor C5 is connected in series with resistor R14, which is connected in common with the other main terminal of the triac T1 to ground. The purpose of the output circuit is to provide the "fast" signal to the electrical valve control 60. Therefore, when the output of the comparator circuit 500 provides an output to the control gate of the triac T1, subsequent to the activation of the relay K1, the "fast" signal is supplied through the now closed relay contact K1-C to the electrical valve control 60, which is connected thereto.

An operating version of the preferred embodiment of the subject invention has been constructed utilizing the following identified elements.

| | | | |
|---|---|---|---|
| A1 | LH201 | R1 | 100 ohms |
| A2 | LH201 | R2 | 24K ohms |
| A3 | LH201 | R3 | 5K ohms |
| A4 | LM311H | R4 | 24K ohms |
| C1 | 1mf Ceramic | R5 | 10K ohms |
| C2 | 1mf | R6 | 24K ohms |
| C3 | 30pf | R7 | 5K ohms |
| C4 | 0.1mf Polycarbonate | R8 | 470K ohms |

-continued

| | | | |
|---|---|---|---|
| C5 | 0.1mf | R9 | 10K ohms |
| Q1 | ½ 2N2920 | R10 | 1M ohms |
| Q2 | ½ 2N2920 | R11 | 150K ohms |
| Q3 | 2N4221A | R12 | 1.5K ohms |
| Q4 | 2N4221A | R13 | 120 ohms |
| Q5 | 2N3904 | R14 | 100 ohms |
| | | T1 | 2N6073A |

In the aforementioned design of the track and hold mode control circuit 300, it was found that a time period of 0.5 second is sufficient enough for the capacitor C4 in the track and hold circuit to acquire a charge corresponding to the ambient temperature of the die cavity. Therefore, the resistor R8 and the capacitor C2 are selected to provide an RC time constant of approximately 0.5 second. When R9 is set to provide an input of 9.4 volts to relay contact K1-B (i.e., one time constant = 63% of 15 volts), it takes approximately 0.5 second for the potential at the junction between R8 and C2 to reach 9.4 volts, at which time the operational amplifier A3 switches from a positive 15 volts to a negative 15 volts.

In actual production, it is often quite difficult or impossible to ladle precise volume amounts of molten material into the injection tube. Accordingly, the predicted time utilized in the prior art to determine when precisely measured ladled molten material will enter the die cavity does not correspond to the actual event when varying amounts of molten material are ladled. Therefore, it should be readily apparent to those skilled in this art, that the present invention has a unique advantage by consistently detecting the actual entry of molten material, to thereby prevent intermixing of air into the injected molten material.

What we claim is:

1. A method of controlling the shot speed in a die casting machine which includes an injection tube for delivering a shot of molten casting material to a die cavity, an injection plunger mounted for translation within said tube at controlled shot speeds, an opening in said tube for receiving a shot of molten casting material internal to said tube in the translational path of said plunger, said die cavity communicating with one end of said tube for receiving said molten material delivered from said tube, wherein said method comprises the steps of:

translating said injection plunger to a first extreme position within said tube to clear said opening;

placing a shot of molten casting material in said opening of said injection tube;

translating said injector plunger from said extreme position towards said die cavity end of said tube at a first predetermined shot speed;

providing a sensing means proximate said die cavity and said one end of said tube for sensing the entry of said molten material to said die cavity and producing a high speed shot signal;

translating said injector plunger at a second predetermined shot speed higher than said first shot speed in response to the production of said high speed shot signal to thereby inject said molten material into said die cavity.

2. A method as in claim 1, wherein said entry of said molten casting material is sensed by employing a thermal sensor and a sensor circuit, wherein said thermal sensor is located within said die cavity proximate said one end of said tube, and is electrically connected to said sensor circuit for detecting a temperature rise of a predetermined amount above the ambient temperature of the die cavity due to said molten material entering said die cavity, wherein said sensor circuit produces said high speed shot signal in response to said temperature rise detection.

3. In a die casting machine comprising: a die defining a die cavity; an injection tube having a first end communicating with said die cavity, a second end external to said die cavity and an opening defined in said tube external to said die for receiving a quantity of molten casting material; an injection plunger mounted for translational movement between first and second positions within said tube, wherein said first and second positions are defined as being proximate respective said first and second ends of said tube;

means connected to said injection plunger for driving said plunger in said translational movement;

means connected to said drive means for controlling the speed and direction of said plunger movement between said first and second positions, wherein said plunger is moved from said second position past said opening at a first speed and subsequently at a second speed, higher than said first speed, to said first position, an improvement comprising:

means for sensing the entry of said molten material into said die cavity, when said plunger is being moved at said first speed and producing a signal indicative of said sensed entry;

said sensing means being located proximate said die cavity and said first end of said tube; and means within said control means for receiving said sensed entry signal and automatically switching the speed at which the drive means is translating said plunger from said first speed to said higher second speed.

4. A machine improvement as in claim 3, wherein said die cavity includes a main die cavity portion and a runner cavity extending from said main portion to said tube and said sensing means includes a temperature sensor located within said runner cavity to produce an electrical signal level indicative of the temperature therein.

5. The machine improvement as in claim 3, wherein said die cavity includes a main die cavity portion and a runner cavity extending from said main portion to said tube and said sensing means includes a temperature sensor located within said runner cavity to detect the temperature thereof and a sensor circuit connected to said temperature sensor for detecting the entry of said molten material into said die cavity.

6. A machine improvement as in claim 5, wherein said temperature sensor is a Chromel/Constantan type thermocouple.

7. A machine improvement as in claim 5, wherein said temperature sensor generates output signals indicative of sensed temperature values, said sensor circuit receives said sensor output signals and said sensor circuit includes means for storing a voltage level proportional to said sensor output signal as a measure of the ambient die temperature and means for comparing said stored level with subsequently received sensor output signals and generating said sensed entry signal when said subsequently received sensor output signals exceed said stored level by a predetermined amount.

8. A machine comprising:

a die for receiving a molten material and casting same;

an injection tube having a first end for receiving a volume of molten material to be cast and a second end with an opening therein allowing evacuation of the contents of said tube to said die;

an injection plunger mounted within said tube for translating movement from approximately said first end to said second end, whereby said plunger ram injects said molten material in said tube to said die, for casting;

a hydraulic system for translating said injection plunger from said first end to said second end of said tube;

an electrical circuit connected to said hydraulic system for controlling the operation thereof; and a temperature sensor mounted proximate with said second end of said tube within said die, to monitor the temperature at that point;

said electrical circuit is connected to said temperature sensor and automatically controls said hydraulic system to translate said plunger at a first speed to feed molten metal to the die cavity and then a second higher speed to fill the die cavity in response to monitored values from said temperature sensor.

9. A machine as in claim 8, wherein said plunger is translated at a first relatively slow speed from said first end of said tube toward said second end;

said circuit includes means for storing the ambient temperature value of said die when no molten material is present therein; and means for comparing the ambient value with susequently monitored values while said plunger is translating at said first speed and producing a signal when said compared values differ by a predetermined amount;

said hydraulic system includes means for responding to said signal and switches the translational speed of said plunger to a second relatively high speed with respect to said first speed, to said second end of said tube.

10. A machine as in claim 9, wherein said temperature sensor is a Chromel/Constantan type thermocouple, which generates predetermined emf values according to the monitored temperature values.

* * * * *